US011014146B2

(12) United States Patent
Hunter et al.

(10) Patent No.: US 11,014,146 B2
(45) Date of Patent: May 25, 2021

(54) METHOD AND APPARATUS FOR FORMING SAND MOLDS VIA TOP AND BOTTOM PNEUMATIC SAND FILLING PERPENDICULAR TO THE PATTERN PLATE

(71) Applicant: HUNTER FOUNDRY MACHINERY CORPORATION, Schaumburg, IL (US)

(72) Inventors: William Gary Hunter, North Barrington, IL (US); Huang Lvting, Fujian (CN)

(73) Assignee: HUNTER FOUNDRY MACHINERY CORPORATION, Schaumburg, IL (US)

( * ) Notice: Subject to any disclaimer, the term of this patent is extended or adjusted under 35 U.S.C. 154(b) by 0 days.

(21) Appl. No.: 17/003,246

(22) Filed: Aug. 26, 2020

(65) Prior Publication Data

US 2020/0391280 A1 Dec. 17, 2020

Related U.S. Application Data

(63) Continuation of application No. 16/162,036, filed on Oct. 16, 2018.

(30) Foreign Application Priority Data

Oct. 20, 2017 (CN) ..... 201721353845.4
Oct. 20, 2017 (CN) ..... 201721353852.4
(Continued)

(51) Int. Cl.
*B22C 15/24* (2006.01)
*B22C 15/28* (2006.01)
(Continued)

(52) U.S. Cl.
CPC ..... *B22C 15/24* (2013.01); *B22C 11/00* (2013.01); *B22C 7/02* (2013.01); *B22C 15/28* (2013.01)

(58) Field of Classification Search
CPC ..... B22C 15/24; B22C 15/28
See application file for complete search history.

(56) References Cited

U.S. PATENT DOCUMENTS 4,126,176 A 11/1978 Muller et al.
4,593,740 A 6/1986 Bühler
(Continued)

FOREIGN PATENT DOCUMENTS

GB 2059836 A * 4/1981 ..... B22C 15/28
JP 54051930 A 4/1979
JP 09052151 A 2/1997

OTHER PUBLICATIONS

U.S. Patent Office, English language version of the International Search Report, Form PCT/ISA/210 for International Application PCT/US2018/56191, dated Dec. 31, 2018 (3 pages).
(Continued)

*Primary Examiner* — Kevin E Yoon
(74) *Attorney, Agent, or Firm* — Pauley Erickson & Swanson

(57) ABSTRACT

A sand molding apparatus and method, whereby cope and drag portions of a sand mold are formed simultaneously via pressurized sand delivered to each side of a pattern in a perpendicular trajectory. Two opposing sand shooting passageways include a vertical inner side wall and a horizontal inner side wall extending at an angle from the vertical inner side wall. A sand shooting plate at the outlet of each sand shooting passageway includes removable and interchangeable port and cover inserts that can be arranged in custom arrays within the sand shooting plate.

20 Claims, 7 Drawing Sheets

(30) Foreign Application Priority Data

| | | |
|---|---|---|
| Oct. 20, 2017 | (CN) | 201721353854.3 |
| Oct. 20, 2017 | (CN) | 201721370921.2 |
| Oct. 20, 2017 | (CN) | 201721370956.6 |

(51) Int. Cl.

| | |
|---|---|
| ***B22C 11/00*** | (2006.01) |
| *B22C 7/02* | (2006.01) |

(56) References Cited

U.S. PATENT DOCUMENTS

| | | | |
|---|---|---|---|
| 4,739,821 | A | 4/1988 | Jensen et al. |
| 5,022,512 | A | 6/1991 | Hunter |
| 5,458,180 | A | 10/1995 | Landua et al. |
| 5,597,029 | A | 1/1997 | Landua |
| 5,927,374 | A | 7/1999 | Hunter et al. |
| 5,971,059 | A | 10/1999 | Hunter et al. |
| 6,145,577 | A | 11/2000 | Hunter et al. |
| 6,622,772 | B1 | 9/2003 | Hunter |
| 6,817,403 | B2 | 11/2004 | Hunter |
| 7,117,924 | B2 | 10/2006 | Hunter |
| 7,210,515 | B2 | 5/2007 | Hunter |
| 8,826,967 | B1 | 9/2014 | Hunter |
| 2008/0023171 | A1 | 1/2008 | Hunter et al. |
| 2012/0328727 | A1 | 12/2012 | Tasasu et al. |
| 2019/0118246 | A1 | 4/2019 | Hunter et al. |
| 2020/0061696 | A1 | 2/2020 | Terabe et al. |

OTHER PUBLICATIONS

U.S. Patent Office, English language version of the Written Opinion of the International Searching Authority, Form PCT/ISA/237 for International Application PCT/US2018/56191, dated Dec. 31, 2018 (9 pages).

* cited by examiner

METHOD AND APPARATUS FOR FORMING SAND MOLDS VIA TOP AND BOTTOM PNEUMATIC SAND FILLING PERPENDICULAR TO THE PATTERN PLATE

CROSS REFERENCE TO RELATED APPLICATION

This application is a continuation of U.S. application, Ser. No. 16/162,036, filed on 16 Oct. 2018. The co-pending parent application is hereby incorporated by reference herein in its entirety and is made a part hereof, including but not limited to those portions which specifically appear hereinafter.

FIELD OF THE INVENTION

This invention relates generally relates to automated molding machines for forming sand molds for use in foundries, and more particularly relates to an apparatus and methods utilizing a pattern plate, a drag flask and a cope flask.

BACKGROUND OF THE INVENTION

Metal castings are commonly manufactured at foundries through a molding technique which employs green sand molds comprised of prepared sand and additives which are compressed around cope and drag patterns mounted on opposite sides of a matchplate. The sand mold is thus formed in upper and lower matching portions, an upper cope mold, and a lower drag mold. The cope mold is formed in a separate cope flask which is filled with prepared sand and compacted onto the matchplate. The matchplate is then removed leaving an indentation in the cope mold of the desired shape for the upper portion of the casting. The drag mold is similarly formed in a separate drag flask. Usually the matchplate is in the form of a planar member with the pattern for the cope mold on one side and the pattern for the drag mold on the other. After the cope and drag molds have been formed, they are placed together to form a unitary mold having an interior cavity of the desired shape. The cavity can then be filled with molten metal through an inlet or "sprue" provided in the cope mold to create the desired casting. Such systems disclosed in U.S. Pat. Nos. 5,022,512, 6,622,772, and 8,826,967, each issued to Hunter, herein incorporated by reference.

Horizontal-type molding machines on the market use side sand shooting, and, especially for a product with a high molded plate height, the sand flowability is hindered due to shielding caused by the pattern plate. This can result in poor filling property, and the hardness of the sand mold after compressing may not be uniform. In addition, shapes of existing sand shooting plates provide an undesirable relatively large sand shooting resistance during the sand shooting process. Abnormal pattern wear, poor green sand cores and surface finish are addition associated issues. Thus there is a continuing need for improved sand casting machines.

SUMMARY OF THE INVENTION

A general object of the invention is to provide an improved sand molding apparatus and method, whereby the cope and drag portions of the sand mold are formed simultaneously via pressurized sand delivered to each side of a pattern from above and/or below, and/or in a perpendicular trajectory. The two mold flask can be rotatable if the matchplate is not in a horizontal orientation.

The invention includes a method and automated matchplate molding machine for blowing sand in a non-horizontal direction into non-horizontally spaced open ends of the cope and drag flasks with a perpendicular trajectory relative to a non-vertically aligned matchplate between the cope and drag flasks. Sand is pneumatically blown from sand magazines through opposing ends of the cope and drag flasks toward the matchplate.

The general object of the invention can be attained, at least in part, through a sand molding apparatus for forming a sand mold about a pattern. The apparatus includes at least one sand shooting passageway including and extending between an inlet and an outlet, wherein the outlet is above and/or below the pattern. The apparatus desirably further includes a sand shooting plate in combination with the outlet. In embodiments of this invention, the apparatus further includes a first sand shooting passageway configured to be disposed over the pattern, and a second sand shooting passageway configured to be disposed under the pattern. Each of the first and second sand shooting passageways including a corresponding sand shooting plate. The first sand shooting passageway provides sand from above the pattern to form the cope mold on the pattern, and the second sand shooting passageway provides sand from below the pattern to form the drag mold under the pattern.

The invention further comprehends a method for forming a sand mold about a pattern. The method includes providing the pattern between a first sand shooting passageway disposed over the pattern and a second sand shooting passageway disposed under the pattern, each of the first and second sand shooting passageways including a corresponding sand shooting plate; forming two portions of a sand mold by delivering air-pressurized sand on each of opposing sides of the pattern, such as from a perpendicular trajectory, through each of the first and second sand shooting passageway; and removing the pattern from between the two portions of the sand mold. A bottom portion of the sand mold desirably sits on a top surface of the sand shooting plate of the second sand shooting passageway upon the forming of the sand mold.

Embodiments of this invention include a passageway body enclosing the sand shooting passageway. The passageway body including a vertical inner side wall adjacent the outlet and a horizontal inner side wall extending at an angle from the vertical inner side wall toward the inlet. An internal tilted arc plate can be used within the passageway to extend between the vertical inner side wall and a horizontal inner side wall, and over an intersection of the vertical inner side wall and the horizontal inner side wall. The tilted arc plate can be used to prevent blockage caused by sand accumulation at dead angles during the long-term work in the sand shooting passageway.

Embodiments of the present include a sand shooting plate including interchangeable port and cover inserts, arrangeable in custom arrays within the sand shooting plate. In embodiments of this invention, the sand shooting plate includes an upper shooting plate main body and a lower shooting plate, wherein a plurality of sand shooting ports are arranged in an array on the upper shooting plate main body. The back of the sand shooting port processes a sand guiding oblique opening, and the front of the sand shooting port controls the opened and closed sand shooting cover plate. The cover plates are used according to the shape of the work piece to control the array of open sand shooting openings. The sand shooting port of the upper shooting plate can be used to lower resistance against of the sand shooting.

The present invention further includes a casting gate stick that can be attached to the sand shooting plate, for sprue forming. The casting gate stick can be fixed to cover inserts of the sand shooting plate, and can be composed of a first slightly tapered casting gate stick, a second casting gate stick, a casting gate cup body, a direction guide post and a casting gate sleeve. The first casting gate stick is sleeve-joined in the casting gate cup body, the second casting gate stick is sleeve-joined in the first casting gate stick, the direction guide post is provided at the center of the casting gate sleeve, and the second casting gate stick is provided with a hollow passage that accommodates the reciprocating motion of the direction guide post. The invention thereby provides a body-split structure, and simplifies the structure, processing, and manufacturing process of the casting gate cup body, and reduces the maintenance costs when parts need to be replaced.

The present invention further includes lifting devices for the upper sand shooting plate. In some embodiments, the lifting device includes a lifting platform and a hydraulic or pneumatic cylinder disposed at the center of the lifting platform. Direction-guiding columns can be distributed around the cylinder, and direction-guiding sleeves that work together with the direction-guiding column help ensure precision in the height adjustment process of the upper sand shooting plate.

Additional embodiments of the lifting device include screw rods and a driving motor. A primary transmission gear will be provided on the main shaft of the driving motor, which is connected by an intermediary transmission to a transmission sleeve provided on each screw rod. The lifting and lowering are controlled via the helicoid screw rods, by the rotation of the gears connected to the driving motor.

Other objects and advantages will be apparent to those skilled in the art from the following detailed description taken in conjunction with the appended claims and drawings.

DETAILED DESCRIPTION OF THE INVENTION

The present invention provides a sand casting apparatus and method for forming a sand mold about a matchplate pattern. The invention provides an upper and lower sand shooting apparatus, relative to the pattern, for forming both the cope and drag portions of the mold.

Figure 1:
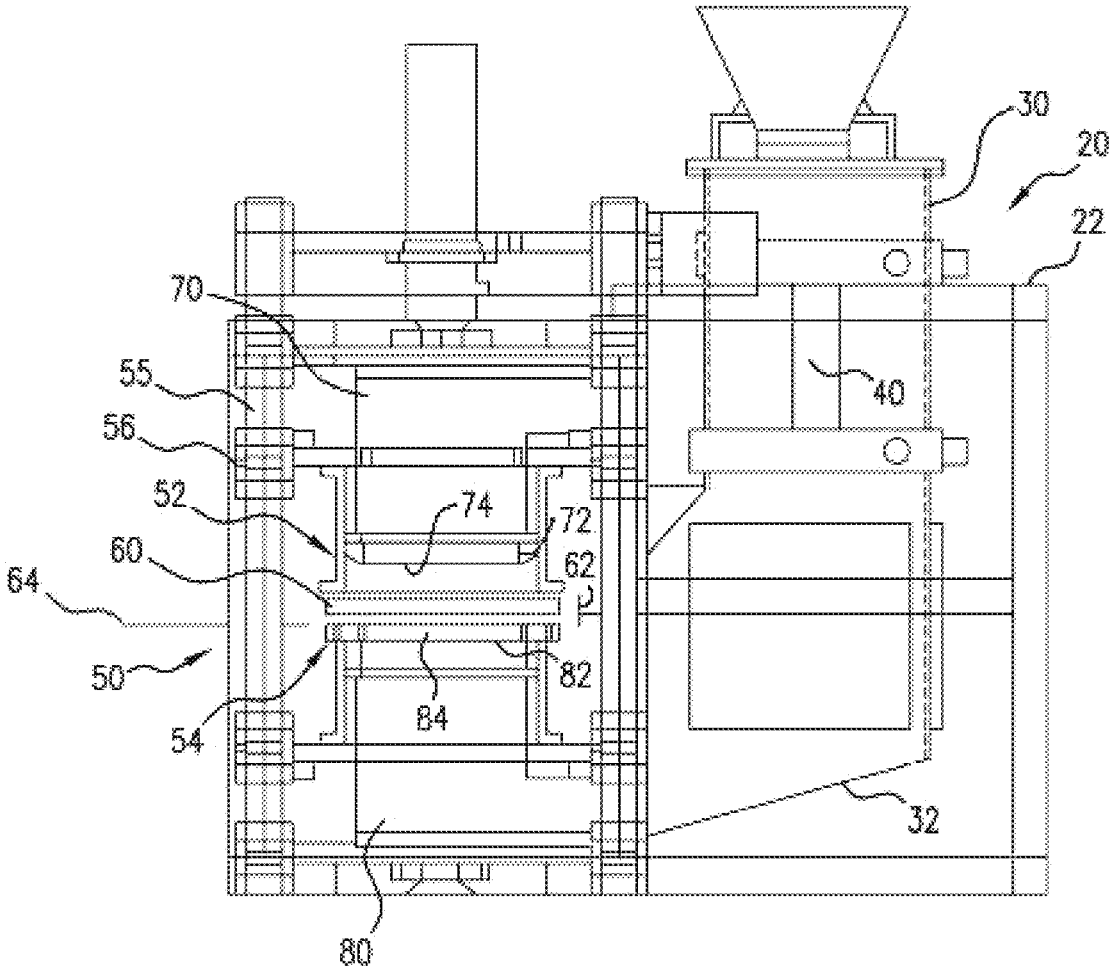
FIG. 1 generally illustrates an automatic matchplate molding machine according to one embodiment of this invention.

FIG. 1 generally illustrates relevant components of an automatic matchplate molding machine according to one embodiment of this invention. Several components are representatively illustrated, and other details are not shown for ease of explanation, such as components including motors, pumps, tubing/hoses, moveable arms, and cladding and lateral sand containment shielding. Machines of these types are well known to those of ordinary skill in the art and are widely used throughout the foundry industry, such that these additional components of commercial machines do not require illustration. In view of the fact that many of the details of different types of molding machines or other such machines are known and also shown generally in the aforementioned patents which have been incorporated by reference, discussion of the general operation of the machine will thus be limited and particular focus will be given to the particular inventive improvements to the machine which are discussed and claimed herein.

As shown in FIG. 1, the molding machine 20 includes a support frame 22. The machine 20 includes a sand hopper 30 which is adapted to hold and discharge sand to form the mold in a mold forming station 50. A manifold 40 extends about the sand hopper 30 to pressurize the sand for delivery to the mold forming station 50. The manifold 40 is connected to a pressurized air supply via tubing, and can provide the air into, and desirably throughout the sand hopper 30 via any known mechanism.

The mold forming station 50 includes a cope flask 52 and a drag flask 54. These flask structure are supported and/or movable on the frame 22 by linear-motion slides 56, or other suitable structure. The linear-motion slides 56 each includes a generally cylindrical bearing housing enclosing a cylindrical linear bearing that wraps around and travels on one of the vertical, cylindrical frame legs 55 of the frame 22. A matchplate pattern 60 is disposed between the cope flask 52 and the drag flask 54, and is moveable laterally to allow the mold halves to be assembled together after mold forming about the pattern 60.

In operation, the matchplate pattern 60 is moved into position as shown between the cope flask 52 and the drag flask 54. The cope flask 52 and/or the drag flask 54 move into a closed position about the matchplate pattern 60, and pressurized sand is injected perpendicularly to and on both sides of the matchplate pattern 60 from above and below, or at any suitable non-horizontal position, forming the upper cope mold and the lower drag mold. The cope flask 52 and/or the drag flask 54 move away from the matchplate 60, and the matchplate 60 is removed to allow the two mold halves to be combined to form a mold on the drag flask 54. A pusher element 62 can be used to push the mold from the drag flask 54 to a further surface 64 outside of the mold forming station 50 to allow the process to repeat.

Delivery of the sand above and below the pattern 60 occurs, respectively, through an upper sand shooting passageway 70 and a lower sand shooting passageway 80. Each sand shooting passageway 70, 80 extends from the hopper 30 and includes an angled change of direction that results in the sand shooting passageways having outlets 72 and 82 facing each other within the mold forming station 50. Each outlet 72 and 82 is covered by a corresponding sand shooting plate 74 and 84, desirably having changeable opening patterns through which the sand dispersion can be controlled over or under the pattern 60. As shown in FIG. 1, the sand hopper 30 includes an angled bottom surface 32 to further promote efficient sand delivery to the sand shooting passageway 80. As will be appreciated, various sizes, shapes, and configurations are available for the sand shooting passageways, the hopper, and/or the shooting plates, depending on need.

In embodiments of this invention, the sand shooting passageway includes an inlet directed toward the sand hopper, an outlet toward the corresponding flask, and a passageway main body including an angled or curved direction change. As illustrated, the passageway main body comprises an L-shaped configuration.

Figure 2:
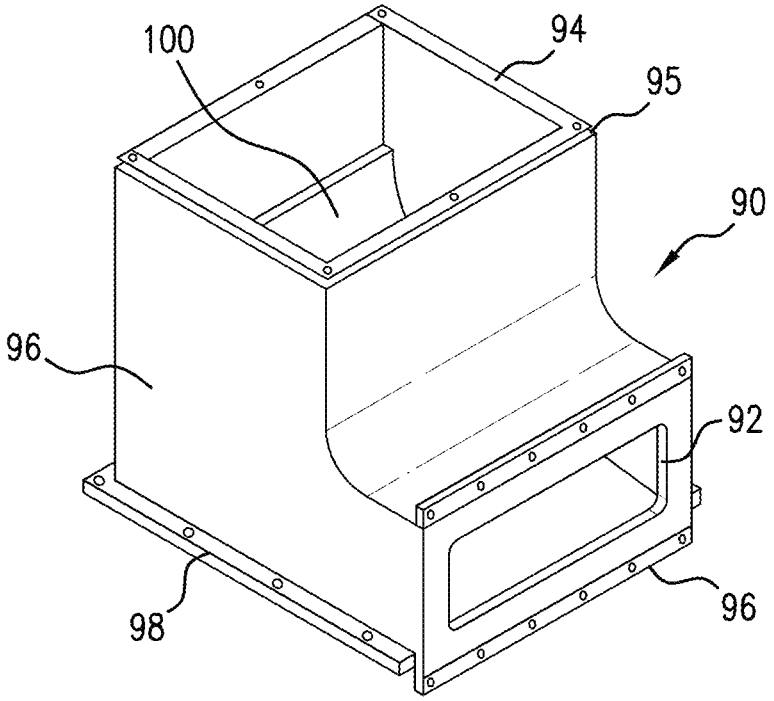
FIG. 2 shows a sand shooting passageway according to one embodiment of this invention.
Figure 3:
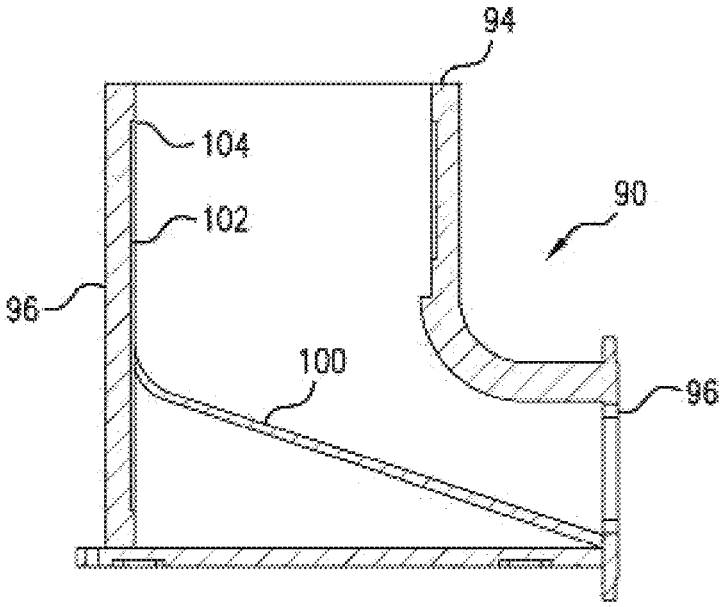
FIG. 3 is a cross-sectional view of the sand shooting passageway according to FIG. 2.
Figure 4:
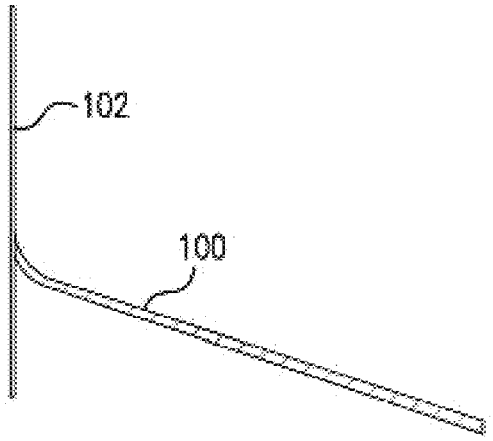
FIG. 4 shows a tilted arc plate according to one embodiment of this invention.

FIGS. 2 and 3 illustrate a sand shooting passageway 90 according to embodiments of this invention. The sand shooting passageway 90 includes an inlet 92, an outlet 94, and a passageway main body 96. The inlet 92 is provided with an outer edge 96 for attachment, for example, to an outlet of the hopper 30. The passageway main body 96 includes a mounting seat 98 as need to connect to the molding machine 20. The outlet 94 can include a sealing strip 95 for connection to a sand shooting plate as discussed further below.

The sand shooting passageway 90 includes an internal tilted arc plate 100 inside the passageway main body 96. The tilted arc plate 100 has one end at, and shown as abutting, an edge of the inlet 92, and the other end is provided with a fixing plate 102 embedded in the vertical inner wall of the passageway main body 96. The vertical inner wall of the passageway main body 96 includes a fixing groove 104 that receives the fixing plate 102, which can be fastened with screws. The tilted arc plate 100 covers the lateral area of the passageway main body 96. The tilted arc plate 100 reduces or prevents the accumulation and retention of sand during the sand shooting process, and thus prevents blockage at the corner of the passageway main body 96, to make the sand shooting process smoother. Various sizes, shapes and configurations are available for the passageway main body and the arc plate. For example, the passageway main body can be formed having a curved interior.

Figure 5:
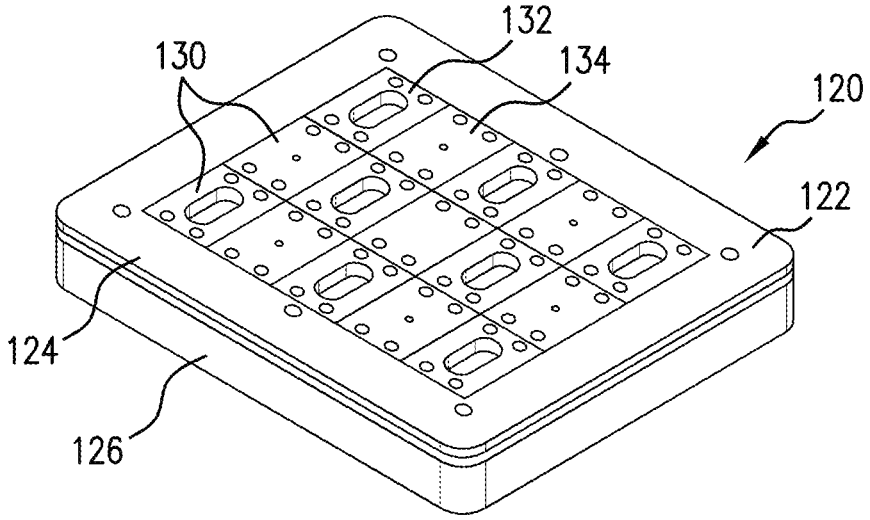
FIG. 5 is a perspective view of a sand shooting plate according to one embodiment of this invention.
Figure 6:
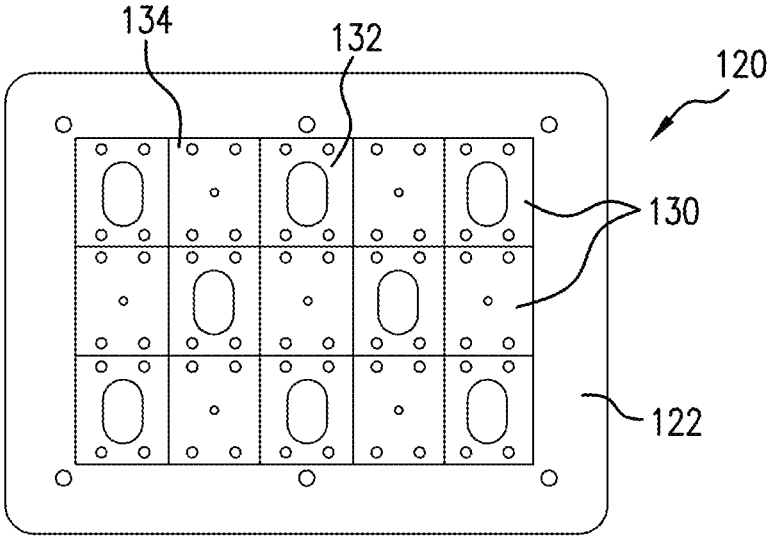
FIG. 6 is a top view of the sand shooting plate of FIG. 5.
Figure 7:
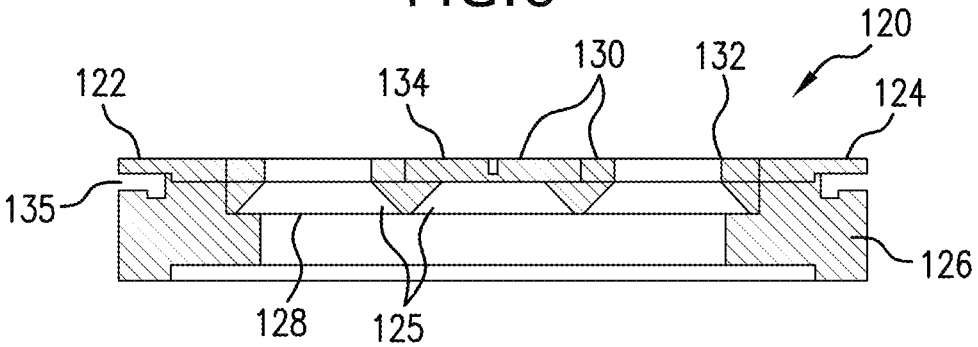
FIG. 7 is a sectional side view of the sand shooting plate of FIG. 5.

Embodiments of this invention include a sand shooting plate over the outlet of the sand shooting passageway. FIGS. 5-7 show a sand shooting plate 120 according to preferred embodiments of this invention. As illustrated in FIGS. 5 and 7, the sand shooting plate 120 includes a flat, fully planar upper surface 122 that is particularly beneficial for use in the drag flask; the flat surface allows for pushing the sand mold off the upper surface 122 without hindrance, as discussed for FIG. 1. The upper cope flask shooting plate does not necessarily benefit from a flat surface, and can have a similar or different structure.

The sand shooting plate of this invention includes moveable and exchangeable shooting ports, which can be moved in position, or exchanged with cover plates, to vary the sand amount and/or distribution, depending on need. As shown in FIGS. 5-7, the sand shooting plate 120 includes an upper main body 124, a lower shooting plate 126, and a sand guiding plate 128 therebetween with an array of oblique openings 125 each having an angled or funnel shape. A groove seat 135 is formed between the upper body 124 and the lower shooting plate 126. A first portion of the groove seat 135 is formed by an upper groove in the upper body 124, and a second portion of the groove seat 135 is formed by a lower groove in the lower plate 126.

A plurality of inserts 130 are arranged, such as by screw or bolt, in an array on the sand guiding plate 128 and within the upper main body 124. Each insert 130 covers one of the openings 125, and can be either a sand shooting port 132, or a cover plate 134 that blocks the corresponding opening 125. The back of each sand shooting port 132 receives sand through the corresponding sand guiding oblique opening 125. The open port inserts 132 or the closed cover plate inserts 134 are moveable or interchangeable across the array to provide for necessary sand amounts and/or injection distribution depending on the matchplate pattern. For example, if the matchplate pattern is larger at one side, then less sand may be required at that side of the mold and fewer open ports 130 are placed at that side. The illustrated array includes three rows and five columns of inserts 130, but other array patterns can be used, such as four rows and/or seven columns, etc. The rows can also be offset from each other as well if needed or desired.

Figure 8:
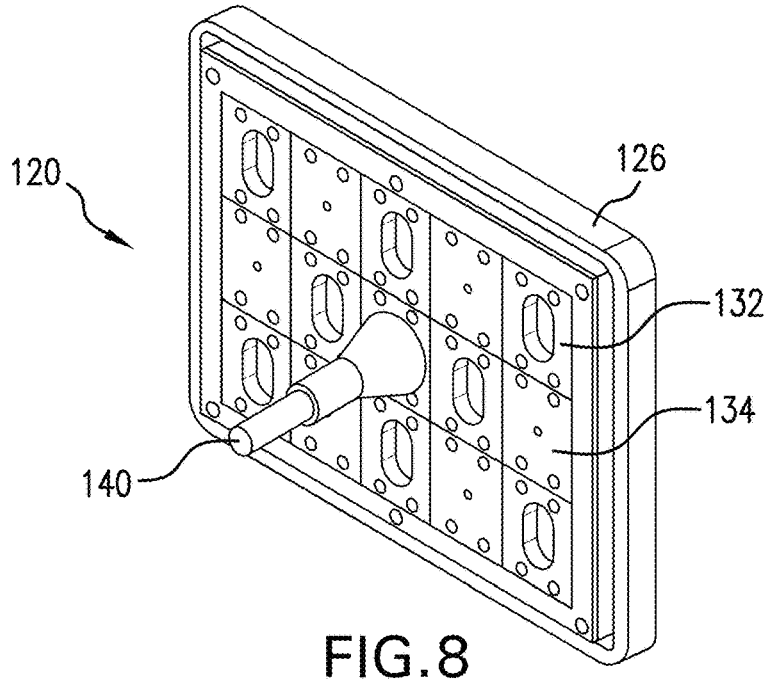
FIG. 8 shows a casting gate stick on a sand shooting plate according to one embodiment of this invention.
Figure 9:
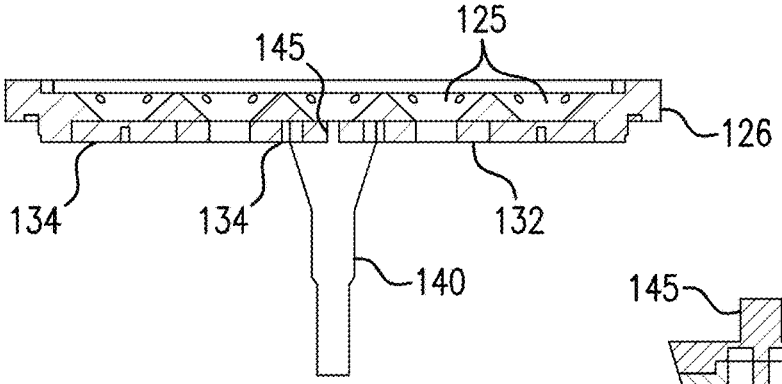
FIG. 9 is a partial side sectional view of the structure of FIG. 8.
Figure 10:
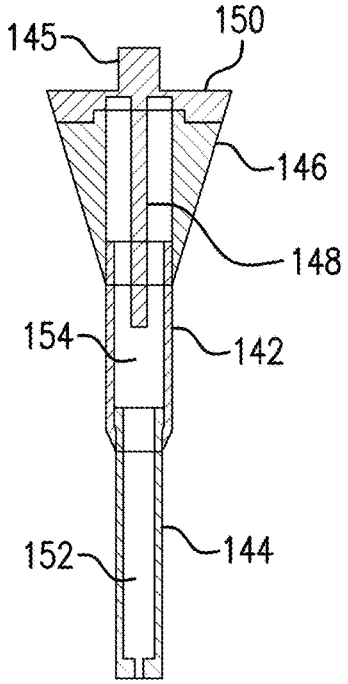
FIG. 10 is a sectional view of a casting gate stick fitting according to one embodiment of this invention.

FIGS. 8-10 show a sand shooting plate 120 according to another embodiment of this invention. The sand shooting plate 120 of FIGS. 8-10 is similar to that shown in FIGS. 5-7, but includes an array of oblique openings 125 that are integrally formed in and through the lower plate 126.

In addition, FIGS. 8-10 show a casting gate stick fitted with the sand shooting plate 120, for forming a sprue within the mold. One or more casting gate sticks 140 is attached to any one or more of the cover inserts 134, such as by a threaded connection 145. Various sprue forming structures can be used with the sand shooting plates of this invention. In FIGS. 8-10, the casting gate stick 140 includes a first casting gate stick 142, a second casting gate stick 144, a casting gate cup body 146, a direction guide post 148, and a casting gate sleeve 150. The first casting gate stick 142 is sleeve-joined via an interference fit to and in the casting gate cup body 146, and the second casting gate stick 144 is sleeve-joined via an interference fit to and in the first casting gate stick 142. The direction guide post 148 is provided at the center of the casting gate sleeve 150, and the second casting gate stick 144 includes a hollow passage 152 that accommodates a reciprocating motion of the direction guide post 148. A sleeve-joint passage 154 in the first casting gate stick 142 accommodates the reciprocating motion of the second casting gate stick 144.

The body-split structure of the casting gate stick 140 provides a simplified structure, processing, and manufacturing process, and can provide reduced maintenance costs when the parts need to be replaced. The combination of the first casting gate stick and the second casting gate stick and the direction guide post has a reduced possibility of tilting and jamming of the casting gate stick, as well as reduced abrasion for the casting gate cup body.

Figure 11:
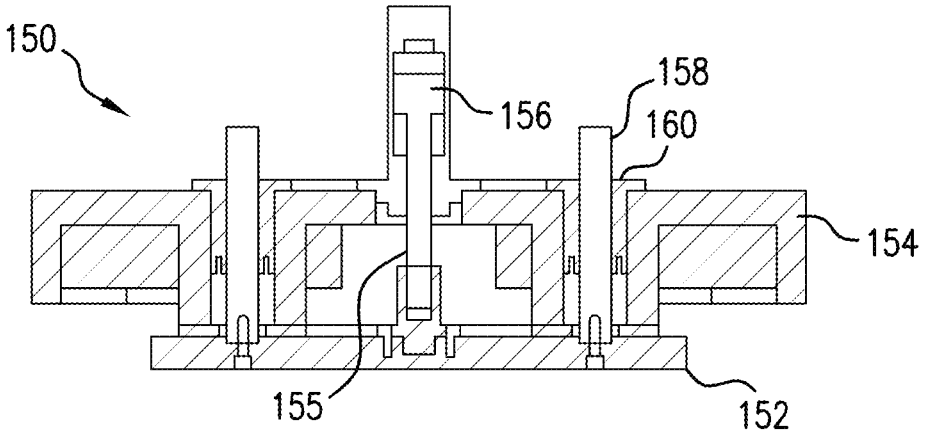
FIG. 11 is a sectional view of a lifting device for a sand shooting plate, according to one embodiment of this invention.
Figure 12:
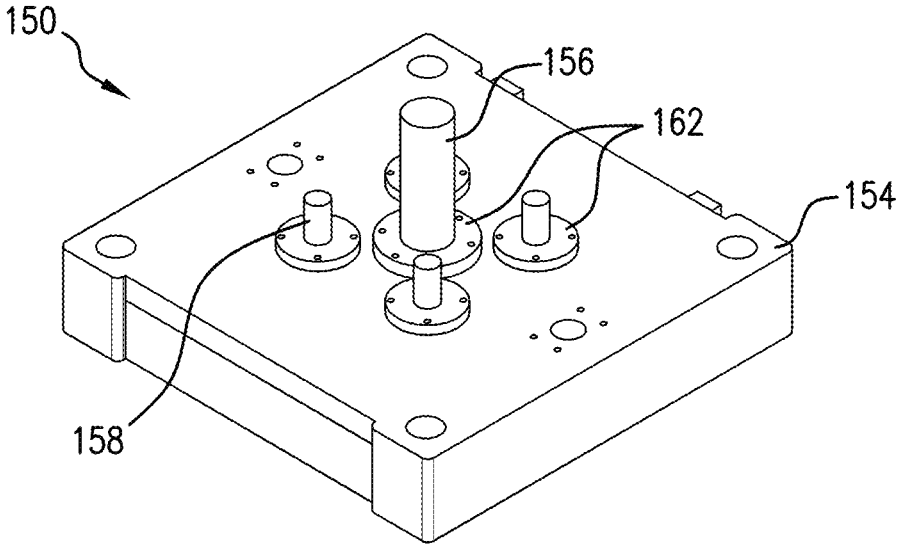
FIG. 12 is a top perspective view of the lifting device of FIG. 11.

In some embodiments of this invention, it may be desirable to adjust the sand shooting plate, and particularly the upper sand shooting plate, such as within the cope flask unit for improved sand casting. FIGS. 11 and 12 show a lifting device 150 according to one embodiment of this invention. The lifting device 150 is provided above a sand shooting plate 152. The lifting device 150 includes a lifting platform 154, an oil cylinder 156 disposed at the center of the lifting platform 154, and one or more direction-guiding columns 158 distributed around the oil cylinder 156. A piston 155 is fixed, such as by a flange, between the sand shooting plate 152 and the oil cylinder 156. The direction-guiding columns 158 are respectively fixed on the sand shooting plate 152 with, for example, screw bolts, and the lifting platform 154 is provided with a direction-guiding sleeve 160 that sits about a corresponding direction-guiding column 158.

Mounting seats 162 are provided at the fitting positions between the lifting platform 154 and each of the oil cylinder 156 and the direction-guiding column 158. The direction-guiding sleeve 160 is sandwiched between mounting seats 162. Various sizes, shapes, amounts, and configurations are available for the components of the lifting device. For example, there are four direction-guiding columns 158 distributed spaced apart around the central cylinder 156, but other numbers of columns can be used, depending on need. The oil cylinder provides lifting and lowering movement, and the direction-guiding column(s) ensure proper positioning, thereby ensuring precision in the height adjustment process of the upper sand shooting plate.

Figure 13:
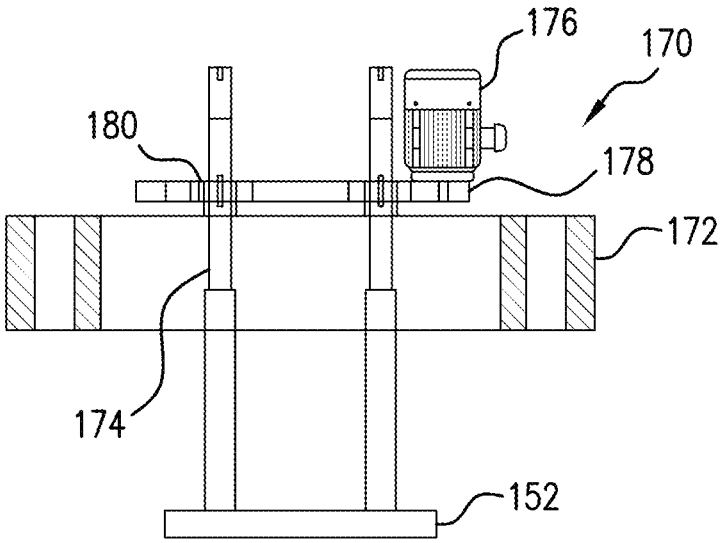
FIG. 13 is a partial sectional view of a lifting device for a sand shooting plate, according to one embodiment of this invention.
Figure 14:
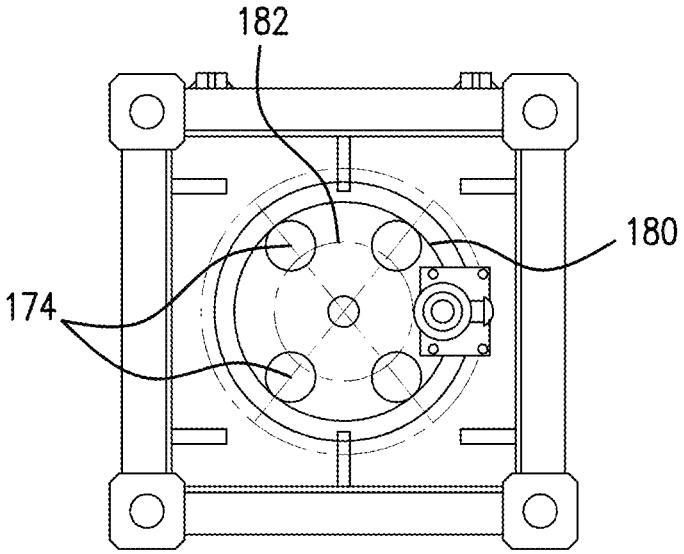
FIG. 14 is a top view of the lifting device of FIG. 13.

FIGS. 13 and 14 show a lifting device 170 according to another embodiment of this invention. The lifting device 170 includes a support frame 172 and four helicoid (or equivalent) screw rods 174. A driving motor 176 is provided on the support frame 172, and a primary transmission gear 178 is provided on the main shaft of the driving motor 176. A transmission sleeve 180 is provided on each screw rod 174, and an auxiliary transmission gear 182 is provided between the primary transmission gear 178 and each transmission sleeve 180. The auxiliary transmission gear 182 meshes with the primary transmission gear 178 and each transmission sleeve 180. An end portion of each screw rod 174 is fixed to the upper surface of the upper sand shooting plate 152. The screw rods 174 are distributed in a square array, or any other suitable pattern. The auxiliary transmission gear 182 is provided in a distribution circle of the array of the screw rods 174, and respectively meshes with the driving sleeves 180 on the screw rods 174 for transmission of motion. The rotation of the gears connected to the driving motor controls the lifting and lowering of four screw rods, thereby controlling the lifting and lowering of the upper sand shooting plate, and provides precision and smoothness in the process of adjusting the height of the upper sand shooting plate during lifting and lowering.

Thus, the invention provides an improved sand casting apparatus and method. The upper and lower sand shooting channels provide improved sand distribution about the molding pattern. The interchangeable ports of the sand shooting plates further provide improved sand distribution and mold formation.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. A sand casting apparatus for forming a sand mold about a pattern, comprising:

at least one angled sand shooting passageway including and extending between an inlet and an outlet, wherein the outlet is above and/or below the pattern;

a sand shooting plate in combination with the outlet, wherein the sand shooting plate comprises a plurality of openings; and a plurality of interchangeable inserts disposable over the plurality of openings, the plurality of interchangeable inserts including sand shooting port inserts and cover plate inserts, wherein each of the inserts is manually placeable and replaceable over one of the openings to control an opening and closing of the sand shooting plate.

2. The apparatus of claim 1, further comprising:

a passageway body enclosing the passageway, the passageway body including a vertical inner side wall and a horizontal inner side wall extending at an angle from the vertical inner side wall toward the inlet; and an internal tilted arc plate within the passageway and extending between the vertical inner side wall and a horizontal inner side wall.

3. The apparatus of claim 2, wherein the passageway body comprises an L-shaped passageway.

4. The apparatus of claim 2, wherein the tilted arc plate covers a lateral area of the passageway body.

5. The apparatus of claim 2, wherein the passageway body comprises a mounting seat at a lower end.

6. The apparatus of claim 1, further comprising:

a first sand shooting passageway configured to be disposed over the pattern;

a second sand shooting passageway configured to be disposed under the pattern, each of the first and second sand shooting passageways including a corresponding sand shooting plate;

a sand hopper; and a manifold with a pressurized air source between the sand hopper and the first and second sand shooting passageways, wherein the manifold is configured to pressurized sand from the sand hopper into each of the first and second sand shooting passageways.

7. The apparatus of claim 6, wherein the first sand shooting passageway provides sand from above the pattern to form an upper cope mold on the pattern, and the second sand shooting passageway provides sand from below the pattern to form a lower drag mold under the pattern.

8. The apparatus of claim 7, wherein the sand shooting plate comprises an upper sand shooting plate body over a lower sand shooting plate body.

9. The apparatus of claim 8, wherein the upper shooting plate body comprises a plurality of sand shooting ports arranged in an array.

10. The apparatus of claim 9, further comprising a sand guiding oblique opening disposed between the outlet and a back of each sand shooting port.

11. The apparatus of claim 9, wherein the array of the sand shooting ports comprises three rows and five or seven columns.

12. The apparatus of claim 7, further comprising a lifting device connected to the sand shooting plate, the lifting device configured to adjust the sand shooting plate relative to the outlet.

13. The apparatus of claim 12, wherein the lifting device comprises a lifting platform, a hydraulic or pneumatic cylinder disposed at about a center of the lifting platform, and a direction-guiding column positioned about the cylinder.

14. A method for forming a sand mold utilizing a flask assembly comprised of at least a cope flask, a drag flask, and a pattern plate, the pattern plate having a pattern for forming a cavity in a sand mold positioned between the cope and drag flasks, the method comprising:

providing the sand casting apparatus of claim 1; and positioning the flask assembly in an orientation that facilitates the pneumatic transfer of the sand in a perpendicular trajectory towards the pattern.

15. The method of claim 14, further comprising:

providing the pattern between a first sand shooting passageway disposed over the pattern and a second sand shooting passageway disposed under the pattern, each of the first and second sand shooting passageways including a corresponding sand shooting plate;

forming two portions of a sand mold by delivering air-pressurized sand in a perpendicular trajectory towards each of opposing sides of the pattern through each of the first and second sand shooting passageway; and removing the pattern from between the two portions of the sand mold, wherein a bottom portion of the sand mold sits on a top surface of the sand shooting plate of the second sand shooting passageway upon the forming of the sand mold.

16. A sand casting apparatus for forming a sand mold about a pattern, comprising:

at least one sand shooting passageway including and extending between an inlet and an outlet, wherein the outlet is above and/or below the pattern;

a sand shooting plate in combination with the outlet;

a passageway body enclosing the passageway, the passageway body including a vertical inner side wall and a horizontal inner side wall extending at an angle from the vertical inner side wall toward the inlet; and an internal tilted arc plate within the passageway and extending between the vertical inner side wall and a horizontal inner side wall, wherein the tilted arc plate has a first end abutting an outer edge of the horizontal inner side wall at the inlet, and a second end including a fixing plate embedded in the vertical inner side wall.

17. The apparatus of claim 16, wherein the vertical inner side wall includes a fixing groove that receives the fixing plate.

18. A sand casting apparatus for forming a sand mold about a pattern, comprising:

at least one sand shooting passageway including and extending between an inlet and an outlet, wherein the outlet is above and/or below the pattern; and a sand shooting plate in combination with the outlet, wherein the sand shooting plate comprises an upper sand shooting plate body over a lower sand shooting plate body, the upper shooting plate body comprises a plurality of sand shooting ports arranged in an array, and further comprising a groove seat between the upper sand shooting plate body and the lower sand shooting plate body.

19. The apparatus of claim 18, wherein a first portion of the groove seat is formed by an upper groove in the upper sand shooting plate body, and a second portion of the groove seat is formed by a lower groove in the lower sand shooting plate body.

20. The apparatus of claim 18, wherein the sand shooting plate comprises a plurality of openings, and further comprising a plurality of interchangeable inserts disposable over the plurality of openings, the plurality of interchangeable inserts including sand shooting port inserts and cover plate inserts, wherein each of the inserts is manually placeable and replaceable over one of the openings to control an opening and closing of the sand shooting plate.

* * * * *